US010020625B2

(12) United States Patent
Tsai et al.

(10) Patent No.: US 10,020,625 B2
(45) Date of Patent: Jul. 10, 2018

(54) ELECTRICAL CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Shuang-Xi Xiao, New Taipei (TW); Yao-Te Wang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 23 days.

(21) Appl. No.: 15/471,880

(22) Filed: Mar. 28, 2017

(65) Prior Publication Data

US 2017/0288356 A1 Oct. 5, 2017

(30) Foreign Application Priority Data

Mar. 29, 2016 (CN) ..... 2016 2 0246272 U

(51) Int. Cl.

| | |
|---|---|
| ***H01R 13/648*** | (2006.01) |
| ***H01R 27/02*** | (2006.01) |
| ***H01R 24/64*** | (2011.01) |
| ***H01R 13/6596*** | (2011.01) |
| ***H01R 13/6585*** | (2011.01) |
| *H01R 107/00* | (2006.01) |

(52) U.S. Cl.

CPC ..... *H01R 27/02* (2013.01); *H01R 13/6585* (2013.01); *H01R 13/6596* (2013.01); *H01R 24/64* (2013.01); *H01R 2107/00* (2013.01)

(58) Field of Classification Search

CPC ..... H01R 12/716; H01R 23/6873; H01R 13/514; H01R 12/724; H01R 13/518

See application file for complete search history.

(56) References Cited

U.S. PATENT DOCUMENTS

| | | | | |
|---|---|---|---|---|
| 7,611,380 | B2 * | 11/2009 | Yuan | H01R 12/725 439/541.5 |
| 7,651,370 | B2 * | 1/2010 | Chuang | H01R 23/6873 439/540.1 |
| 7,677,925 | B2 * | 3/2010 | Chuang | H05K 5/0247 439/541.5 |
| 7,758,380 | B2 * | 7/2010 | Wang | H01R 27/02 439/541.5 |
| 7,762,840 | B2 * | 7/2010 | Hamner | H01R 13/65802 439/541.5 |
| 8,096,831 | B2 * | 1/2012 | Hsu | H01R 12/724 439/607.01 |
| 9,281,642 | B1 * | 3/2016 | Tseng | H01R 24/60 |
| 9,640,923 | B2 * | 5/2017 | Kao | H01R 12/724 |
| 9,722,374 | B2 * | 8/2017 | Hsu | H01R 27/02 |
| 2016/0352049 | A1 * | 12/2016 | Long | H01R 13/659 |

* cited by examiner

*Primary Examiner* — Xuong Chung Trans
(74) *Attorney, Agent, or Firm* — Muncy, Geissler, Olds & Lowe, P.C.

(57) ABSTRACT

An electrical connector is provided, including a plastic core having a frame and at least one partition plate integrally formed with the frame for defining a plurality of recesses, a first connector received in one of the recesses, and a second connector received in another one of the recesses. As such, the instant disclosure only needs to solder the electrical connector to a circuit board of an electronic product so as for the electronic product to obtain a plurality of connector ports, thus greatly reducing the fabrication time.

14 Claims, 7 Drawing Sheets

ELECTRICAL CONNECTOR

CROSS-REFERENCE TO RELATED APPLICATION

This application claims priority to Chinese Patent Application No. 201620246272.4, filed on Mar. 29, 2016, the entirety of which is incorporated by reference herein.

BACKGROUND OF THE DISCLOSURE

1. Technical Field

The instant disclosure relates to connectors, and more particularly to an electrical connector.

2. Description of Related Art

An electrical connector is used for electrically connecting wires, circuit boards or other electronic elements. Electrical connectors are widely applied in various electronic products, such as computers, laptops, mobile phones and so on.

Generally, different connectors are designed for different kinds of circuits, and therefore a connector can only connect a corresponding kind of circuits. Since many kinds of transmission circuits are generally provided in a single electronic product to achieve multi-function, a plurality of electrical connectors are required by the electronic product.

However, to fabricate such an electronic product, each of the electrical connectors needs to be soldered to the circuit board of the electronic product, thus resulting in a significant increase in the fabrication time.

Therefore, how to overcome the above-described drawbacks has become critical.

SUMMARY

In view of the above-described drawbacks, the instant disclosure provides an electrical connector, which comprises: a plastic core having a frame and at least one partition plate integrally formed with the frame for defining a plurality of recesses; at least one first connector received in one of the recesses, wherein the first connector comprises a first metallic shell structure defining a receiving space and having a port and an opening communicating with the receiving space, an insulating housing disposed in the receiving space of the first metallic shell structure and having an upper base portion and a tongue portion extending from the upper base portion, a shielding plate disposed inside the insulating housing, and two rows of first conductive terminal sets disposed on the insulating housing and arranged on two opposite sides of the shielding plate, respectively, each of first conductive terminals of the first conductive terminal sets having a contact portion disposed on the tongue portion and a soldering portion disposed on the upper base portion; and at least one second connector received in another one of the recesses, wherein the second connector comprises a second metallic shell structure and at least one second conductive terminal set received in the second metallic shell structure, each of second conductive terminals of the second conductive terminal set having one soldering end extending from the second metallic shell structure.

In an embodiment, the first connector is a USB type-C connector.

In an embodiment, the first connector and the second connector are of the same type. In another embodiment, the first connector and the second connector are of different types.

In an embodiment, the upper base portion of the first connector is exposed from the opening, and the tongue portion is exposed from the port.

In an embodiment, the second connector has at least one conductive contact element disposed on an outer surface thereof and the plastic core has an aperture formed therein for exposing the conductive contact element.

In an embodiment, the frame of the plastic core has two lateral plates and a support plate connecting the two lateral plates for defining a receiving space, and the partition plate is disposed in the receiving space of the frame.

In an embodiment, the electrical connector further comprises a terminal organizer connected to the second connector and received in the plastic core.

In an embodiment, the electrical connector further comprises a shell for receiving the plastic core. In another embodiment, the shell and the plastic core are engaged through a concave-and-convex structure. In yet another example, the shell and the plastic core are connected by a guide rail structure.

Therefore, the plastic core of the electrical connector according to the instant disclosure allows the first connector and the second connector to be received in different recesses of the plastic core. As such, the instant disclosure only needs to solder the electrical connector to a circuit board of an electronic product so as for the electronic product to obtain a plurality of connector ports, thus greatly reducing the fabrication time.

DETAILED DESCRIPTION

The following illustrative embodiments are provided to illustrate the instant disclosure, these and other advantages and effects can be apparent to those in the art after reading this specification.

It should be noted that all the drawings are not intended to limit the instant disclosure. Various modifications and variations can be made without departing from the spirit of the instant disclosure. Further, terms such as "upper", "lower", "front", "rear", "left", "right", "first", "second", "a" etc. are merely for illustrative purposes and should not be construed to limit the scope of the instant disclosure.

Figure 1A:
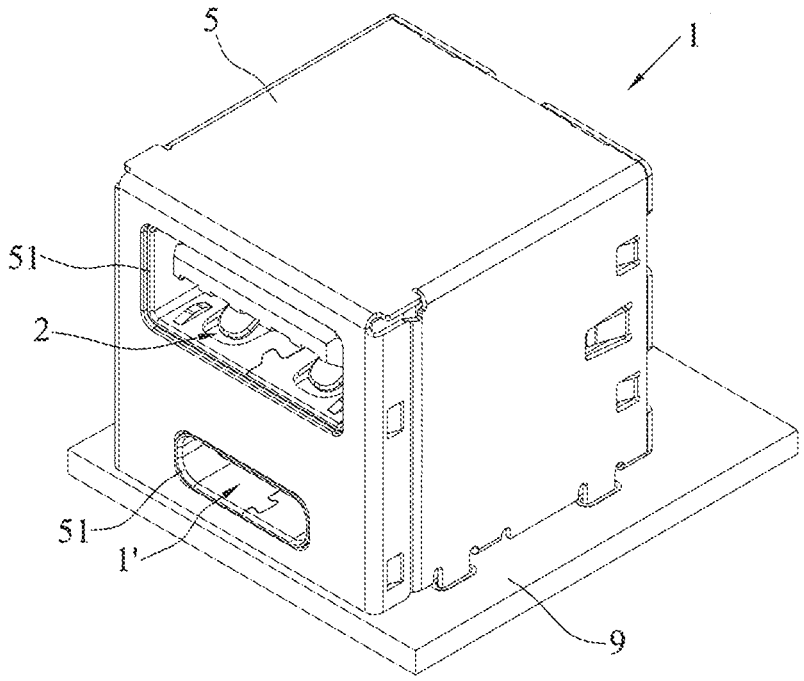
FIG. 1A is a front perspective view of an electrical connector and an electronic device according to the instant disclosure.
Figure 1B:
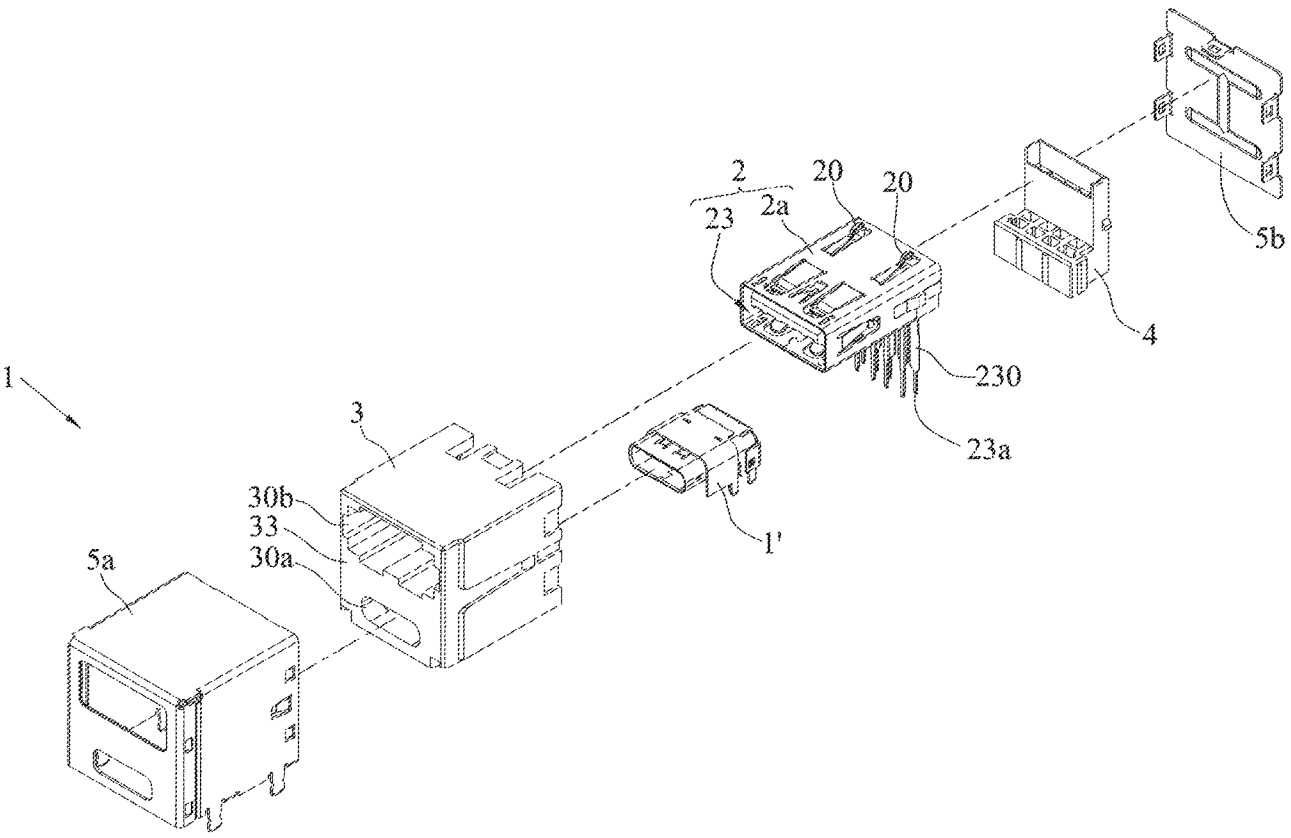
FIG. 1B is an exploded view of the electrical connector according to the instant disclosure.

FIGS. 1A and 1B are schematic views of an electrical connector 1 according to the instant disclosure. The electrical connector 1 has a first connector 1', a second connector 2, and a plastic core 3.

Figure 2A:
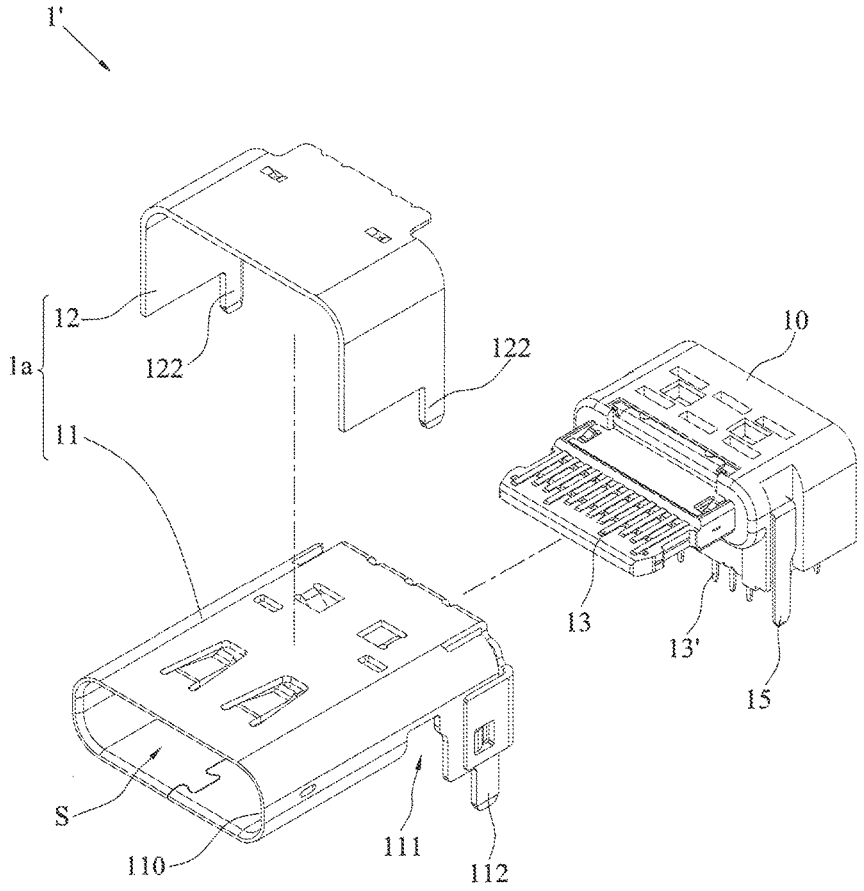
FIG. 2A is an exploded view of a first connector of the electrical connector according to the instant disclosure.
Figure 2B:
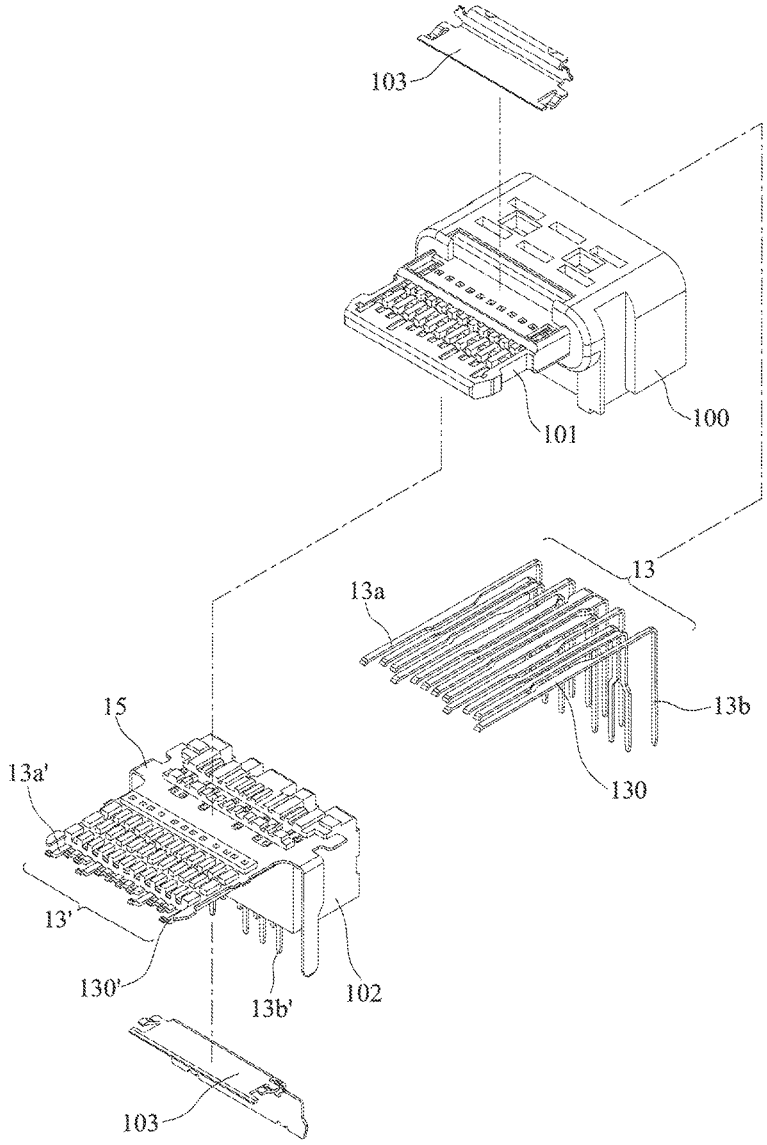
FIG. 2B is a partially exploded view of FIG. 2A.

Further referring to FIGS. 2A and 2B, the first connector 1' has an insulating housing 10, a first metallic shell structure 1*a*, two rows of first conductive terminal sets 13 and 13', and a shielding plate 15.

In an embodiment, the first connector 1' is a Universal Serial Bus (USB) type connector. In another embodiment, the first connector 1' is a USB type-C connector.

The first metallic shell structure 1*a* has a first shell 11 (such as an inner shell) and a second shell 12 (such as an outer shell). A receiving space S is formed in the first shell 11 for receiving the insulating housing 10 and the two rows of first conductive terminal sets 13 and 13'. In an embodiment, the first shell 11 and the second shell 12 are made of metal, for example, iron. The first shell 11 has a port 110 formed at a front side of the receiving space S, and an opening 111 formed at a rear side of the receiving space S and facing downward. The first shell 11 is partially covered by the second shell 12 and protrudes from the front side of the second shell 12, as shown in FIG. 1B. In another embodiment, the first shell 11 can be completely covered by the second shell 12.

In an embodiment, the first shell 11 and the second shell 12 have a plurality of pins 112 and 122 disposed at left and right sides thereof, respectively, and extending downward for mounting the first connector 1' to an electronic device 9 (for example, a circuit board of FIG. 1A).

Referring to FIG. 2B, the insulating housing 10 has an upper base portion 100, a tongue portion 101, a lower base portion 102 and two electromagnetic compatibility (EMC) pads 103. The tongue portion 101 extends forward from the upper base portion 100.

In an embodiment, the insulating housing 10 is disposed inside the first shell 11 in a manner such that the tongue portion 101 is exposed from the port 110 and the insulating housing 10 or the upper base portion 100 is exposed from the opening 111.

The two rows of first conductive terminal sets 13 and 13' have a plurality of first conductive terminals 130 and 130', respectively. The first conductive terminal sets 13 and 13' are exposed and fixed to upper and lower sides of the insulating housing 10, respectively. Each of the first conductive terminals 130, 130' has a contact portion 13*a*, 13*a'* disposed on the tongue portion 101 and a soldering portion 13*b*, 13*b'* protruding from the rear side of the first shell 11 for electrically connecting to the electronic device (circuit board) 9.

In an embodiment, each of the first conductive terminals 130, 130' extends from the tongue portion 101 toward the upper base portion 100 and bends downward so as to have a curved bar shape. As such, the contact portions 13*a* and 13*a'* of the first conductive terminals 130 and 130' are exposed from the port 110, and the soldering portions 13*b* and 13*b'* of the first conductive terminals 130, 130' protrude from the opening 111.

In an embodiment, the first conductive terminals 130, 130' include ground (GND) terminals, power/VBUS terminals and reserved (RFU) terminals. Furthermore, differential signal terminals can be added according to the practical need.

In another embodiment, the upper-side first conductive terminal set 13 extends on the upper base portion 100 and the tongue portion 101, the lower-side first conductive terminal set 13' is disposed on the lower base portion 102, and the contact portions 13*a'* thereof are positioned on the tongue portion 101. The two electromagnetic compatibility (EMC) pads 103 are disposed on the upper side of the tongue portion 101 and the lower side of the lower base portion 102, respectively.

The shielding plate 15 is disposed inside the insulating housing 10. The first conductive terminal set 13 is arranged above the upper side of the shielding plate 15, and the first conductive terminal set 13' is arranged under the lower side of the shielding plate 15. That is, the shielding plate 15 is disposed between the two rows of first conductive terminal sets 13 and 13'.

In an embodiment, referring to FIG. 1B, the second connector 2 has a second metallic shell structure 2*a* and at least one second conductive terminal set 23 received in the second metallic shell structure 2*a*. The second conductive terminal set 23 has a plurality of second conductive terminals 230 and each of the second conductive terminals 230 has an soldering end 23*a* downwardly extending out the second metallic shell structure 2*a*.

In an embodiment, the second connector 2 is a USB type connector. In another embodiment, the second connector 2 is a USB type-A connector. That is, the first connector 1' and the second connector 2 may be of different types. It should be understood that the first connector 1' and the second connector 2 can be of the same type.

Figure 3A:
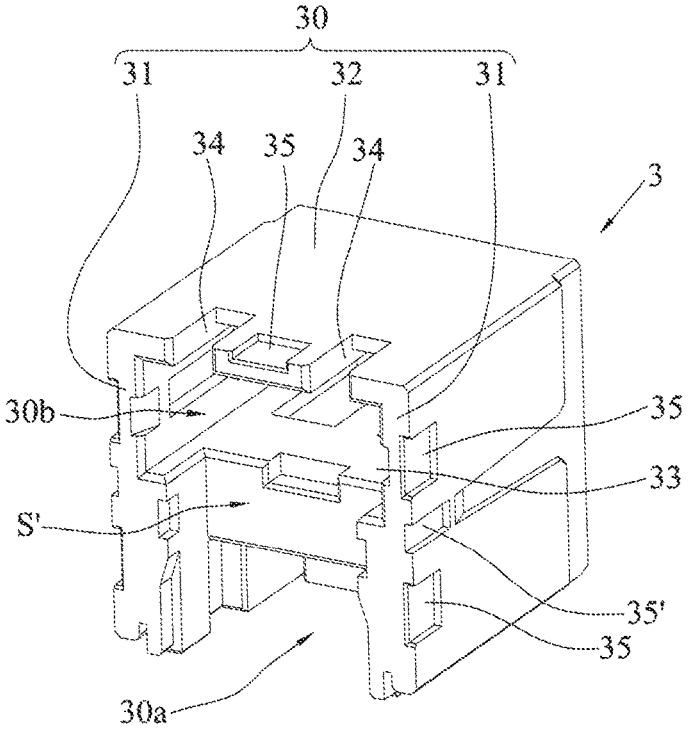
FIG. 3A is a rear upper view of a plastic core of the electrical connector according to the instant disclosure.
Figure 3B:
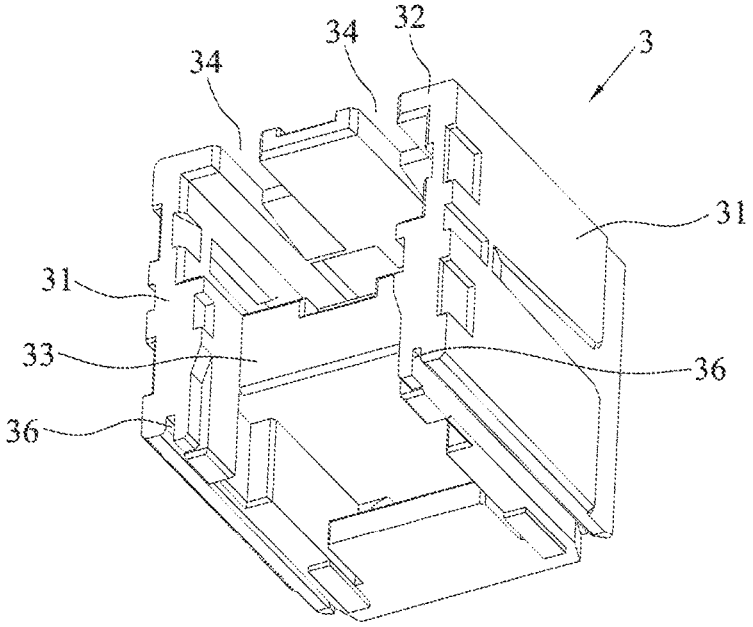
FIG. 3B is a rear bottom view of the plastic core of the electrical connector according to the instant disclosure.

Referring to FIGS. 3A and 3B, the plastic core 3 has a frame 30 and at least one partition plate 33 integrally formed with the frame 30 for defining at least two recesses 30*a* and 30*b*. The first connector 1' and the second connector 2 are received in the recesses 30*a* and 30*b*, respectively.

In an embodiment, referring to FIG. 3A, the frame 30 of the plastic core 3 has two lateral plates 31 and a support plate 32 connecting the two lateral plates 31 for defining a receiving space S'. The receiving space S' is open at the lower side thereof. Further, the partition plate 33 is formed in the receiving space S' to partition the receiving space S' into the two recesses 30*a* and 30*b*.

Figure 4A:
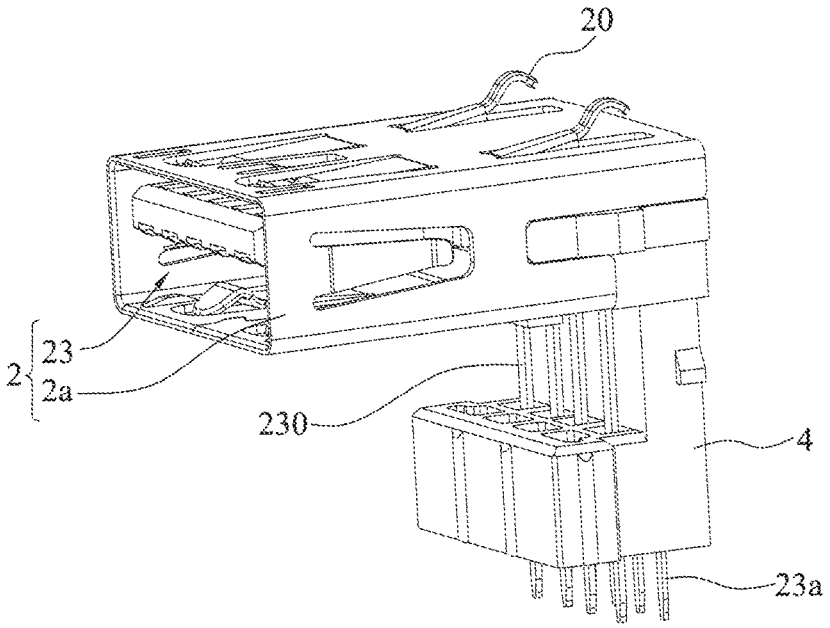
FIG. 4A is a front side view of a second connector and a terminal organizer of the electrical connector according to the instant disclosure.
Figure 4B:
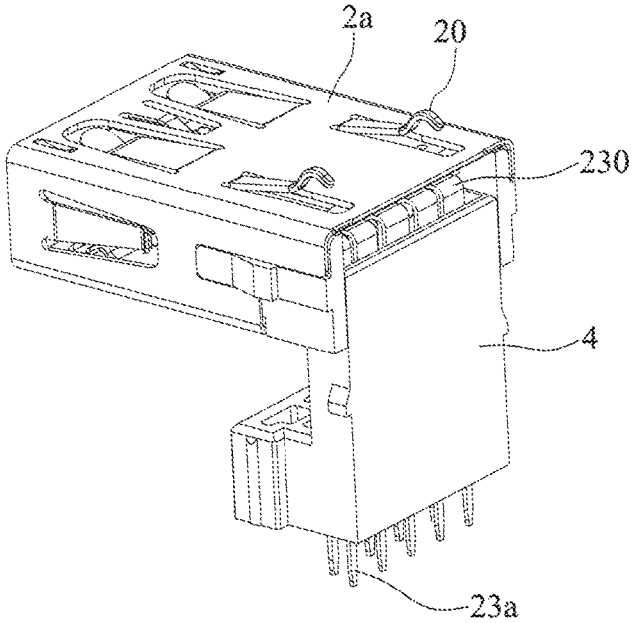
FIG. 4B is a rear side view of the second connector and the terminal organizer of the electrical connector according to the instant disclosure.

The first connector 1' is disposed in the lower recess 30*a* of the plastic core 3, and the second connector 2 is disposed in the upper recess 30*b* of the plastic core 3. Therefore, compared with the first conductive terminals 130 and 130' of the first connector 1', the second conductive terminals 230 of the second connector 2 are longer for connecting to the electronic device (circuit board) 9. Referring to FIGS. 1B, 4A and 4B, the electrical connector 1 further has a terminal organizer 4 connected to the second connector 2 and received in the plastic core 3. In an embodiment, the terminal organizer 4 is made of a plastic material. The terminal organizer 4 is used to fix the second conductive terminals 230 of the second connector 2 so as to prevent the second conductive terminals 230 from bending and contacting with one another, and hence avoid occurrence of a short circuit. Further, the terminal organizer 4 prevents the second conductive terminals 230 from contacting with the air so as to improve the electrical performance of the second conductive terminals 230. That is, the terminal organizer 4 has a shielding function. The terminal organizer 4 can also adjust the impedance of the second connector 2 when high frequency signals are transmitted by the second connector 2.

Further, the second metallic shell structure 2*a* has a plurality of conductive contact elements 20 disposed on an outer surface thereof and the plastic core 3 has a plurality of apertures 34 correspondingly exposing the conductive contact elements 20.

In addition, the electrical connector 1 has a shell 5 for receiving the plastic core 3. The shell 5 is made of metal such as iron. The shell 5 has a shell body 5*a* and a cover body 5*b*. In an embodiment, referring to FIGS. 1A, 1B, 5A and 5B, the shell body 5*a* is open at the lower side and has a plurality of openings 51 formed at the front side for correspondingly exposing the recesses 30*a* and 30*b*. The cover body 5*b* is fixed to the rear side of the plastic core 3.

In an embodiment, the shell 5 and the plastic core 3 are engaged through a concave-and-convex structure. In an embodiment, the cover body 5*b* has a plurality of first protruding portions 50 and the shell body 5*a* has a plurality of second protruding portions 50'. The plastic core 3 has a plurality of first recessed portions 35 correspondingly engaging with the first protruding portions 50 of the cover body 5*b* and a plurality of second recessed portions 35' correspondingly engaging with the second protruding portions 50' of the shell body 5*a*. Further, the first protruding portions 50 have through holes 500 correspondingly engaging with the second protruding portions 50'.

Figure 5A:
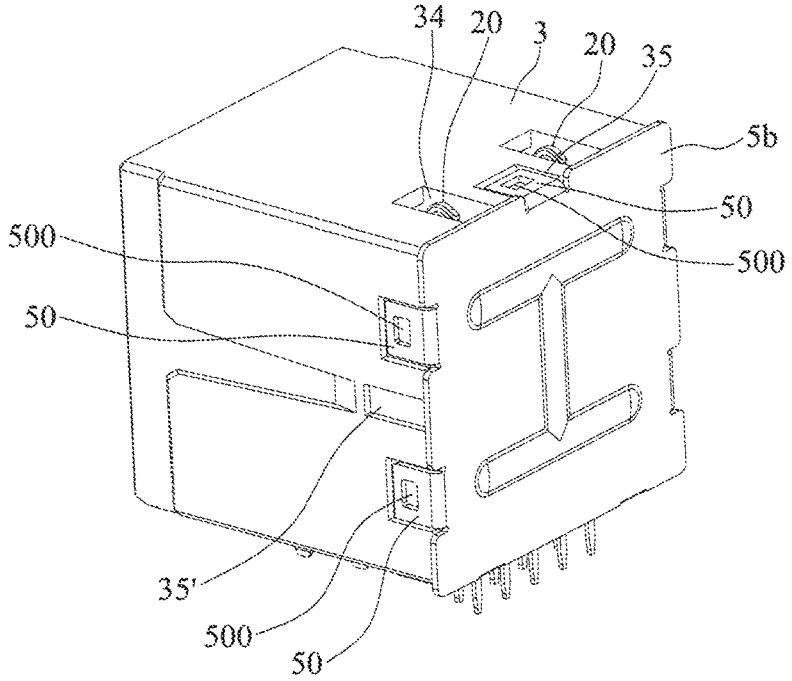
FIG. 5A is a rear perspective view of the plastic core and a cover of the electrical connector according to the instant disclosure.
Figure 5B:
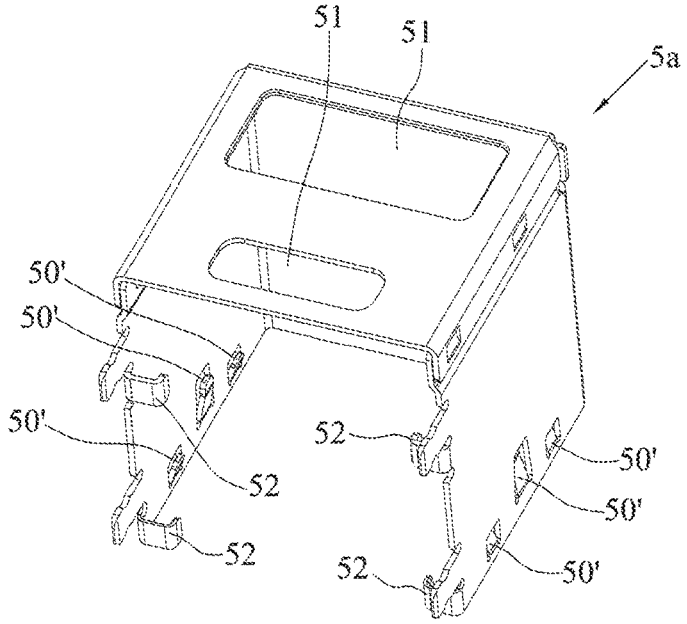
FIG. 5B is a front bottom view of a shell of the electrical connector according to the instant disclosure.

During assembly, the first protruding portions 50 engage with the recessed portions 35 so as to fix the cover body 5*b* to the rear side of the plastic core 3 (as shown in FIG. 5A) and then the second protruding portions 50' engage with the second recessed portions 35' and the through holes 500 so as to receive the plastic core 3 in the shell body 5*a*. As such, the front, rear, left, right and upper sides of the plastic core 3 are covered by the shell 5.

Preferably, the shell 5 and the plastic core 3 are connected by a guide rail structure. In an embodiment, referring to FIGS. 3B and 5B, each of the lateral plates 31 of the plastic core 3 has a recessed guide rail 36 disposed at the lower side thereof, and the shell body 5*a* has a plurality of inward-bent leads 52 disposed at the lower side thereof. During assembly, the leads 52 slide along the guide rails 36 so as to cause the plastic core 3 to move toward the shell body 5*a* until the second protruding portions 50' engage with the second recessed portions 35' and the through holes 500.

Therefore, during assembly of the electrical connector 1, the second connector 2 is connected to the terminal organizer 4 first and then the first connector 1' and the second connector 2 are received in the plastic core 3 along with the terminal organizer 4. Thereafter, the cover body 5*b* is fixed to the rear side of the plastic core 3. Subsequently, the plastic core 3 is received in the shell body 5*a*.

Further, since the conductive contact elements 20 of the second connector 2 are exposed from the apertures 34 of the plastic core 3, as shown in FIG. 5A, when the plastic core 3 is received in the shell body 5*a*, the conductive contact elements 20 will come into contact with the shell body 5*a* so as to improve the shielding effect of the second connector 2.

Therefore, the plastic core 3 of the electrical connector 1 according to the instant disclosure allows the first connector 1' and the second connector 2 to be received in the recesses 30*a* and 30*b* of the plastic core 3, respectively. As such, during fabrication of an electronic product, the instant disclosure only needs to solder the electrical connector 1 to an electronic device (circuit board) 9 such as a circuit board so as for the electronic product to obtain a plurality of connector ports, thus greatly reducing the fabrication time.

The above-described descriptions of the detailed embodiments are only to illustrate the preferred implementation according to the instant disclosure, and it is not to limit the scope of the instant disclosure. Accordingly, all modifications and variations completed by those with ordinary skill in the art should fall within the scope of instant disclosure defined by the appended claims.

What is claimed is:

1. An electrical connector, comprising:

a plastic core having a frame and at least one partition plate integrally formed with the frame for defining a plurality of recesses, wherein each of the recesses is a hollowed space penetrating through the plastic core to form a front opening and a rear opening;

at least one first connector received in one of the recesses and comprising:

a first metallic shell structure defining a receiving space and having a port and an opening communicating with the receiving space;

an insulating housing disposed in the receiving space of the first metallic shell structure and having a base portion and a tongue portion extending from the base portion;

a shielding plate disposed inside the insulating housing; and two rows of first conductive terminal sets disposed on the insulating housing and arranged on two opposite sides of the shielding plate, respectively, each of first conductive terminals of the first conductive terminal sets having a contact portion disposed on the tongue portion and a soldering portion extended out the base portion; and at least one second connector received in another one of the recesses and comprising:

a second metallic shell structure; and at least one second conductive terminal set received in the second metallic shell structure, each of second conductive terminals of the second conductive terminal set having one soldering end extending out the second metallic shell structure.

2. The electrical connector of claim 1, wherein the first connector is a USB t e-C connector.

3. The electrical connector of claim 1, wherein the first connector and the second connector are of the same type.

4. The electrical connector of claim 1, wherein the base portion of the first connector is exposed from the opening, and the tongue portion is exposed from the port.

5. The electrical connector of claim 1, wherein the second connector has at least one conductive contact element disposed on an outer surface thereof, and the plastic core has an aperture formed therein for exposing the conductive contact element.

6. The electrical connector of claim 1, wherein the frame of the plastic core has two lateral plates and a support plate connecting the two lateral plates for defining a receiving space, and the partition plate is disposed in the receiving space of the frame.

7. The electrical connector of claim 1, further comprising a teiniinal organizer connected to the second connector and received in the plastic core.

8. The electrical connector of claim 1, further comprising a shell configured for receiving the plastic core.

9. The electrical connector of claim 8, wherein the shell and the plastic core are engaged through a concave-and-convex structure.

10. The electrical connector of claim 8, wherein the shell and the plastic core are connected by a guide rail structure.

11. The electrical connector of claim 1, wherein the first connector and the second connector are of different types.

12. The electrical connector of claim 1, wherein the base portion comprises an upper base portion and a lower base portion, and the tongue portion extends forward from the upper base portion.

13. The electrical connector of claim 12, wherein the shielding plate is disposed between the two rows of first conductive terminal sets.

14. The electrical connector of claim 13, wherein the first connector further comprises at least two electromagnetic compatibility (EMC) pads disposed on an upper side of the tongue portion and a lower side of the lower base portion, respectively.

* * * * *